US011843216B2

(12) United States Patent
Mizukami

(10) Patent No.: US 11,843,216 B2
(45) Date of Patent: Dec. 12, 2023

(54) CRIMP STRUCTURE

(71) Applicant: Tyco Electronics Japan G.K., Kawasaki (JP)

(72) Inventor: Kazuhiro Mizukami, Kawasaki (JP)

(73) Assignee: Tyco Electronics Japan G. K., Kawasaki (JP)

( * ) Notice: Subject to any disclaimer, the term of this patent is extended or adjusted under 35 U.S.C. 154(b) by 0 days.

(21) Appl. No.: 17/080,222

(22) Filed: Oct. 26, 2020

(65) Prior Publication Data

US 2021/0126384 A1 Apr. 29, 2021

(30) Foreign Application Priority Data

Oct. 25, 2019 (JP) ..... 2019-194503

(51) Int. Cl.
*H01R 9/05* (2006.01)
*H01B 7/02* (2006.01)
*H01R 24/40* (2011.01)

(52) U.S. Cl.
CPC ..... *H01R 9/0518* (2013.01); *H01B 7/0216* (2013.01); *H01R 24/40* (2013.01)

(58) Field of Classification Search
CPC ..... H01R 24/40; H01R 13/502
See application file for complete search history.

(56) References Cited

U.S. PATENT DOCUMENTS

| | | | | |
|---|---|---|---|---|
| 3,828,298 | A * | 8/1974 | Schumacher | H01R 9/0512 439/442 |
| 5,123,864 | A | 6/1992 | Karlovich | |
| 6,107,572 | A | 8/2000 | Miyazaki | |
| 6,217,381 | B1 | 4/2001 | Kameyama | |
| 6,398,563 | B1 * | 6/2002 | Kanagawa | H01R 9/0518 439/587 |
| 7,868,251 | B2 * | 1/2011 | Gladd | H02G 15/025 174/72 A |
| 9,004,957 | B2 | 4/2015 | Aizawa et al. | |
| 2011/0244721 | A1 | 10/2011 | Amidon | |

FOREIGN PATENT DOCUMENTS

| | | | |
|---|---|---|---|
| DE | 3211008 | A1 | 10/1983 |
| EP | 1246316 | A1 | 10/2002 |
| JP | S55161373 | U | 12/1980 |
| JP | 5661774 | A | 5/1981 |
| JP | S647778 | U | 1/1989 |
| JP | 668938 | A | 3/1994 |
| JP | 2002510130 | A | 4/2002 |
| JP | 200624499 | A | 1/2006 |
| JP | 2008159312 | A | 7/2008 |
| JP | 2009054357 | A | 3/2009 |
| JP | 2011187176 | A | 9/2011 |

(Continued)

OTHER PUBLICATIONS

Abstract of JP 2017126551, dated Jul. 20, 2017, 1 page.

(Continued)

*Primary Examiner* — Jean F Duverne
(74) *Attorney, Agent, or Firm* — Barley Snyder

(57) ABSTRACT

A crimp structure includes a crimp section having an insulated ferrule disposed inside an outer conductor of a shielded cable. The outer conductor and a ground contact placed on an outer periphery of the outer conductor are crimped.

12 Claims, 6 Drawing Sheets

(56) References Cited

FOREIGN PATENT DOCUMENTS

| | | | |
|---|---|---|---|
| JP | 201259397 | A | 3/2012 |
| JP | 2014154530 | A | 8/2014 |
| JP | 201515513 | A | 1/2015 |
| JP | 2017126551 | A | 7/2017 |

OTHER PUBLICATIONS

European Search Report, dated Feb. 19, 2021, 11 pages.
English translation of DE 3211008A1, dated Oct. 20, 1983, 8 pages.
English translation of JP S5661774 (original document filed in IDS on Oct. 26, 2020), dated May 27, 1981, 7 pages.
Japanese Office Action and English translation, Application No. 2019-194503, dated Jul. 18, 2023, 10 pages.

* cited by examiner

CRIMP STRUCTURE

CROSS-REFERENCE TO RELATED APPLICATION

This application claims the benefit of the filing date under 35 U.S.C. § 119(a)-(d) of Japanese Patent Application No. 2019-194503, filed on Oct. 25, 2019.

FIELD OF THE INVENTION

The present invention relates to a crimp and, more particularly, to a crimp structure in which a ground contact is crimped to an outer conductor used as the shield of a shielded cable.

BACKGROUND

A shielded cable includes a core wire, an insulation layer that surrounds the core wire, and an outer conductor that surrounds the insulation layer. A connector, to which an end of the shielded cable is connected, includes a signal contact connected to the core wire and a ground contact that is spaced from the signal contact and surrounds the signal contact. Japanese Patent No. 56-61774A discloses a connector including a dielectric body, which is attached to an end of a coaxial cable, a conductive socket housing that covers a first portion of the dielectric body, an outer conductor of the coaxial cable, placed on the outer periphery of the dielectric body and the socket housing, and a crimp including a ferrule that crimps the outer conductor.

Signal transmission speeds (frequencies) are ever increasing. To efficiently transmit the high-speed (high-frequency) signals, the impedances of a shielded cable and a connector connected to an end of the shielded cable need to match. A mismatch of the impedances therebetween leads to signal reflection, resulting in the deterioration of the efficiency of the transmission of signals. To match the impedances therebetween, the connection to the signal contact and ground contact needs to be made while maintaining a radial distance between the core wire and outer conductor of the shielded cable. If we assume a case where the outer conductor and ground contact of the shielded cable are crimped without taking particular measures, the diameter of the dielectric body of the shielded cable would be reduced, resulting in a decrease in a radial distance between the core wire and the outer conductor or the ground contact, causing a mismatch of the impedance.

In the case of the connector in JP 56-61774A, the dielectric material and the socket housing are placed inside the outer conductor, to prevent the reduction in diameter. In the case of the connector of JP 56-61774A, however, the conductive socket housing is embedded up to some midpoint. Therefore, the radial distance between the core wire (the central axis of an inner conductor, described in JP 56-61774A) and the outer conductor of the socket housing is not uniform, and a mismatch of the impedance is more likely to occur.

SUMMARY

A crimp structure includes a crimp section having an insulated ferrule disposed inside an outer conductor of a shielded cable. The outer conductor and a ground contact placed on an outer periphery of the outer conductor are crimped.

BRIEF DESCRIPTION OF DRAWINGS

The invention will now be described by way of example with reference to the accompanying Figures, of which.

DETAILED DESCRIPTION OF THE EMBODIMENT(S)

Figure 1A:
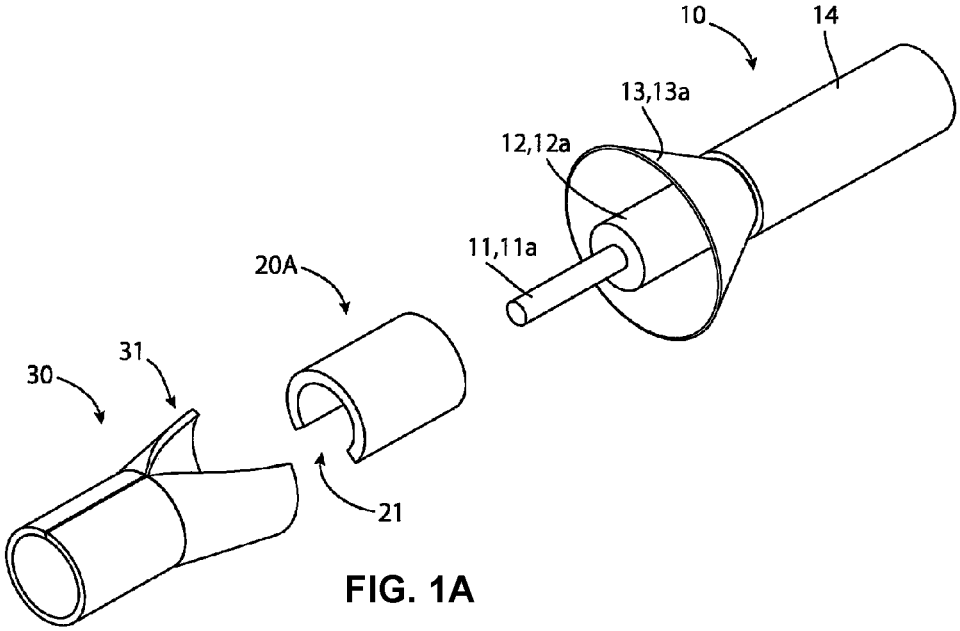
FIG. 1A is an exploded perspective view of a crimp structure according to an embodiment before crimping.

Exemplary embodiments of the present disclosure will be described hereinafter in detail with reference to the attached drawings, wherein like reference numerals refer to like elements. The present disclosure may, however, be embodied in many different forms and should not be construed as being limited to the embodiments set forth herein; rather, these embodiments are provided so that the present disclosure will convey the concept of the disclosure to those skilled in the art.

A crimp structure according to an embodiment is shown before crimping in FIG. 1A and after crimping in FIGS. 1B-3B. The crimp structure includes a shielded cable 10, a ferrule 20A according to a first example, and a ground contact 30. In the context of the present invention, the term "shielded cable" is a broad concept encompassing coaxial cables.

Figure 3A:
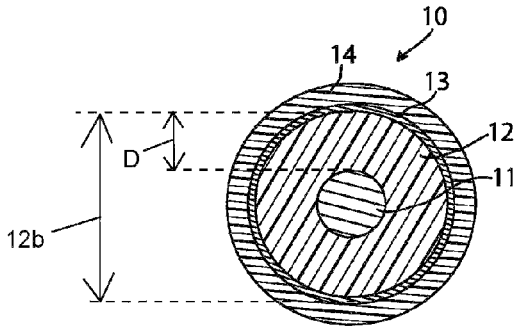
FIG. 3A is a sectional end view of the crimp structure, taken along line Y1-Y1 of FIG. 1B.

The shielded cable 10, as shown in FIGS. 1A and 3A, includes a core wire 11, an insulation layer 12 surrounding the core wire 11, an outer conductor 13 surrounding the insulation layer 12, and a shell 14 covering the outer conductor 13. The core wire 11 and the outer conductor 13 have conductivity, and the insulation layer 12 and the shell 14 have insulation properties. The insulation layer 12 is made of expanded polyethylene, crosslinked polyethylene, crosslinked expanded polyethylene, crosslinked expanded polyolefin, or polypropylene having a relative permittivity of around 1.0 to 2.0.

A leading end 11*a* of the core wire 11 is bared in FIG. 1A. The core wire 11 is crimped to a signal contact. However, the signal contact is not a feature of the present embodiment, and an illustration of the signal contact is omitted herein. Furthermore, in FIG. 1A, a leading end 13*a* of the outer conductor 13 is broadened in cone form, and a leading end 12*a* of the insulation layer 12 is exposed.

The ferrule 20A has an insulation property. In the ferrule 20A shown in FIG. 1A, a cut portion 21 is formed at one place in the circumferential direction of the cylindrical shape thereof. The cut portion 21 extends along the overall length in parallel to the central axis of the ferrule 20A, and it is obtained by cutting a section between the inner and outer peripheries of the generally cylindrical shape thereof. The ferrule 20A has a shape obtained by broadening the cylindrical shape thereof due to the cut portion 21.

Figure 1B:
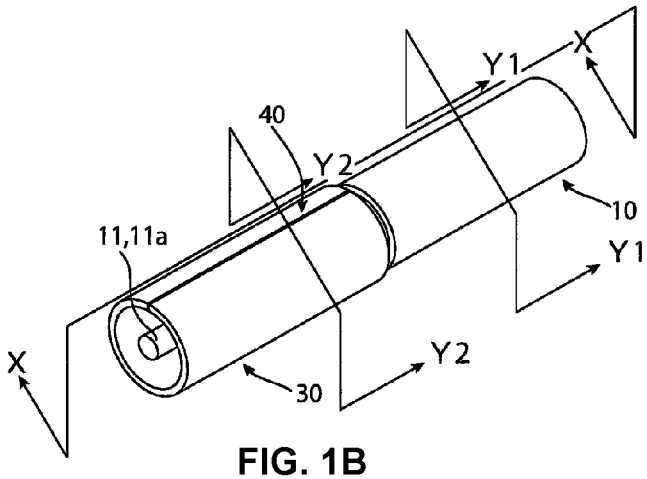
FIG. 1B is a perspective view of the crimp structure of FIG. 1A after crimping.

The insulation layer 12 of the shielded cable 10 is covered with the ferrule 20A broadened as in FIG. 1A, the outer conductor 13 is placed around the ferrule 20A, and the ground contact 30 is further placed to surround the outer conductor 13. The shape illustrated in FIG. 1B is then formed by crimping.

In a crimp section 40 formed by the crimping, shown in FIGS. 1B-3B, the core wire 11, the insulation layer 12, the ferrule 20A, the outer conductor 13, and the ground contact 30 are placed in the order from the inner side. When the insulation layer 12 surrounding the core wire 11 is left in the crimp section, it is necessary to temporarily widen the ground contact 30 in order to place the insulation layer 12 inside the ground contact 30. In the case of widening the ground contact 30, a cut portion 31 may be formed on it, the ground contact 30 may be divided into two parts, or the ground contact 30 may have a structure connected by a hinge.

Figure 2A:
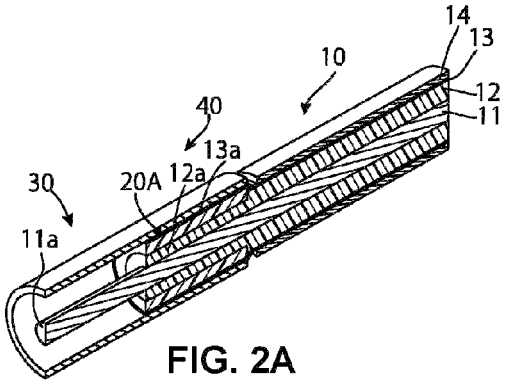
FIG. 2A is a sectional perspective view of the crimp structure, taken along line X-X of FIG. 1B.
Figure 2B:
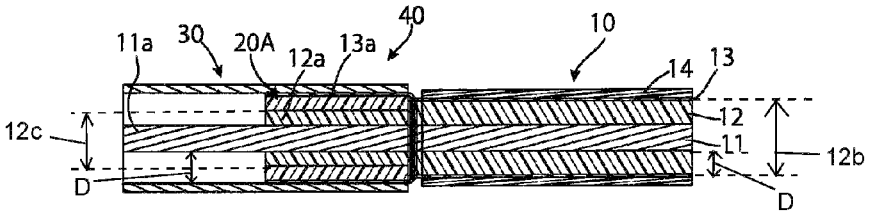
FIG. 2B is a sectional side view of the crimp structure, taken along line X-X of FIG. 1B.
Figure 3B:
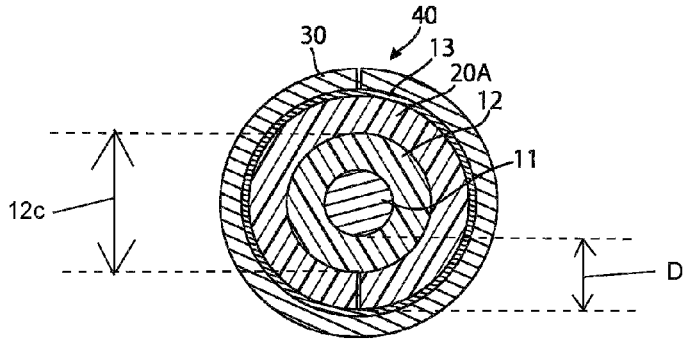
FIG. 3B is a sectional end view of the crimp structure, taken along line Y2-Y2 of FIG. 1B.

As illustrated in FIGS. 2A and 2B, or as seen from comparison between FIG. 3A and FIG. 3B, the diameter of the insulation layer 12 is reduced by the crimping, the insulation layer 12 having a first diameter 12*b* outside of the crimp section 40 and a second diameter 12*c* less than the first diameter 12*b* in the crimp section 40. The ferrule 20A is placed to compensate a thickness portion corresponding to the reduction in the diameter. In the present embodiment, impedance between the shielded cable 10 and the crimp section 40 is matched by placing the ferrule 20A in such a manner. A distance D between the core wire 11 and the outer conductor 13 or the ground contact is maintained to realize impedance matching using the ferrule 20A, the insulated ferrule 20A maintains the distance D between the core wire 11 and the outer conductor 13 in the crimp section 40 to be equal to the distance D between the core wire 11 and the outer conductor 13 outside of the crimp section 40, as shown in FIGS. 2B, 3A, and 3B. As a result, the reflection of signals in the crimp section 40 is suppressed to achieve a structure suitable for high-speed signal transmission.

Various embodiments of the ferrule will be described below.

Figure 4A:
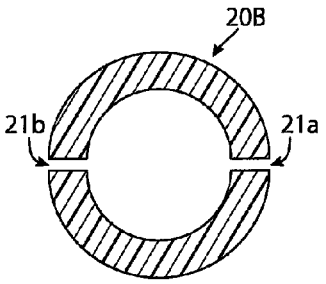
FIG. 4A is a sectional end view of a ferrule according to another embodiment.
Figure 4B:
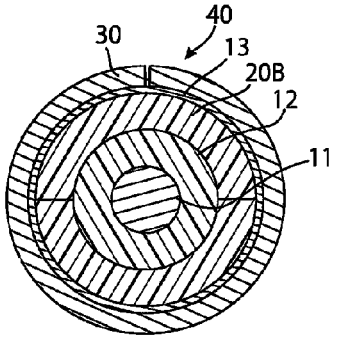
FIG. 4B is a sectional end view of a crimp structure including the ferrule of FIG. 4A.

A ferrule 20B according to another embodiment is shown in FIG. 4A and is shown crimped in a crimp structure in FIG. 4B. The ferrule 20B according to the second example is divided into two parts in parallel to the central axis thereof to form divided portions 21*a* and 21*b* at two places in the circumferential direction thereof so that both the parts that are allowed to coalesce are generally cylindrical. The adoption of the ferrule 20B divided into the two parts results in improvement in workability in crimping.

Figure 5A:
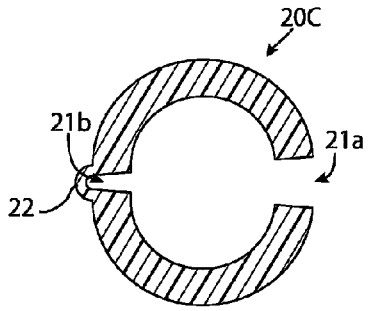
FIG. 5A is a sectional end view of a ferrule according to another embodiment.

A ferrule 20C according to another embodiment is shown in FIG. 5A. Like the ferrule 20B according to the second example in FIG. 4A, the ferrule 20C according to the third example illustrated in FIG. 5A is divided into two parts in parallel to the central axis thereof to form divided portions 21*a* and 21*b* at two places in the circumferential direction thereof so that both the parts that are allowed to coalesce are generally cylindrical. However, the ferrule 20C according to the third example further has a shape in which one divided portion 21*b* is connected via a hinge 22. When both the two parts into which the ferrule is divided are linked via the hinge 22 in such a manner, workability in crimping is further improved in comparison with a ferrule merely divided into two parts.

Figure 5B:
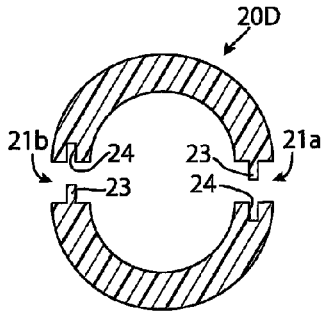
FIG. 5B is a sectional end view of a ferrule according to another embodiment.

Like the ferrule 20B according to the second example in FIG. 4A, a ferrule 20D according to another embodiment in FIG. 5B is also divided into two parts in the central axis direction thereof to form divided portions 21*a* and 21*b* at two places in the circumferential direction thereof so that both the parts that are allowed to coalesce are generally cylindrical. In the ferrule 20D according to the fourth example, a recess-and-projection structure including a projection 23 and a recess 24 which are mated with each other is further formed in each of the divided portions 21*a* and 21*b*. When such a recess-and-projection structure is formed, each divided portion can be temporarily fixed, and workability in crimping is further improved in comparison with a ferrule merely divided into two parts.

Figure 6A:
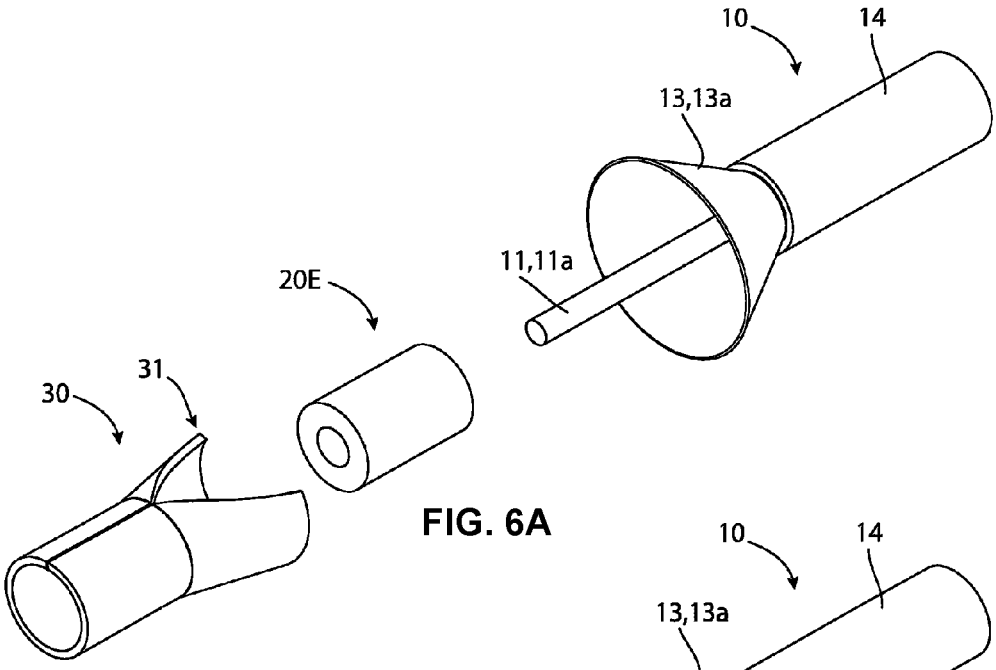
FIG. 6A is an exploded perspective view of a crimp structure according to another embodiment before crimping.

FIG. 6A illustrates a crimp structure before crimping, including a ferrule 20E according to another embodiment. A difference from the crimp structure shown in FIG. 1A will be described. In a shielded cable 10 shown in FIG. 6A, the leading end 12*a* of the insulation layer 12 is removed, and a broadened leading end 13*a* of an outer conductor 13 and a core wire 11 directly face each other.

The ferrule 20E according to the embodiment shown in FIG. 6A has a simple cylindrical shape. The inner diameter of the cylinder of the ferrule 20E is a diameter that allows the core wire 11 of the shielded cable 10 to be just only inserted. The outer diameter of the ferrule 20E is generally identical to the outer diameter of the ferrule 20A according to the first example after the crimping, illustrated in FIG. 2B or FIG. 3B. A ground contact 30 in FIG. 6A is similar to that in FIG. 1A.

In other words, in the case of the ferrule 20E of FIG. 6A, the insulation layer 12 is absent in the crimp 40, and both the insulation layer 12 and ferrule 20A of the crimp 40 illustrated in FIG. 2B or FIG. 3B are replaced with the ferrule 20E. As described above, the insulation layer 12 surrounding the core wire 11 of the shielded cable 10 in the crimp 40 may be removed, and the ferrule 20E may directly surround the core wire 11 of the shielded cable 10. In any of these cases, the distance between the core wire 11 and the outer conductor 13 or the ground contact can be maintained to match the impedances.

Figure 6B:
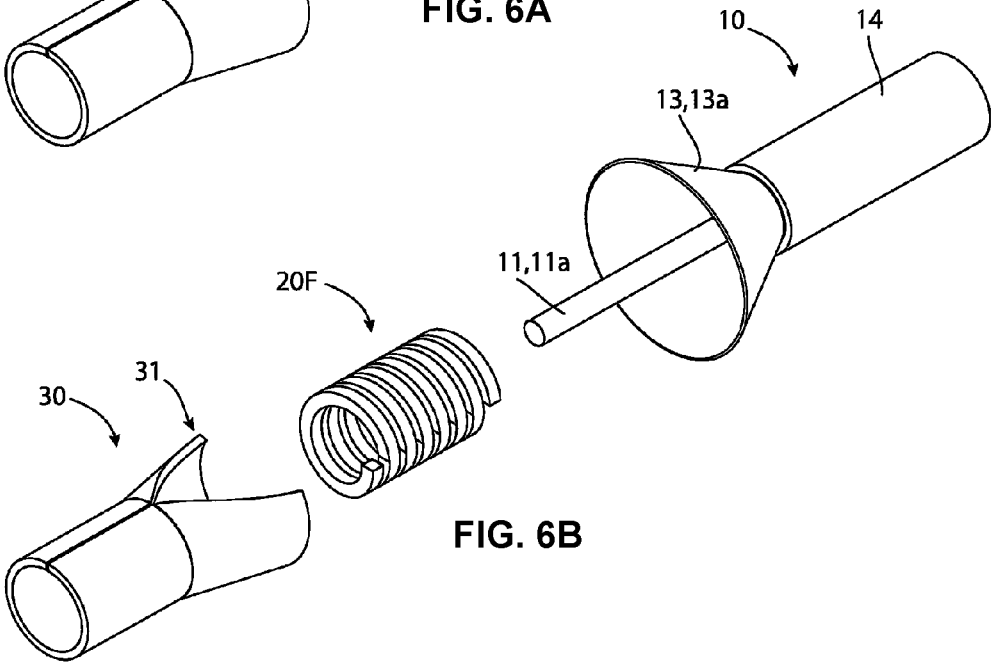
FIG. 6B is an exploded perspective view of a crimp structure according to another embodiment before crimping.

FIG. 6B illustrates a crimp structure before crimping, including a ferrule 20F according to another embodiment. A difference from the crimp structure shown in FIG. 1A will be described. The ferrule 20F according to the embodiment of FIG. 6B has a shape in which the ferrule 20F is wound in coil form. The inner diameter of the coil is larger than the diameter of the core wire 11. A shielded cable 10 and a ground contact 30 in FIG. 6B are similar to those in FIG. 6A.

The diameter of the ferrule 20F according to the embodiment of FIG. 6B is reduced up to a diameter that allows the inner surface of the ferrule 20F to come in contact with a core wire 11 by crimping. The inner diameter of the ferrule 20F according to the sixth example before crimping is larger than the outer diameter of the core wire 11. Accordingly, the core wire 11 is easily inserted into the ferrule 20F, and workability in crimping is improved.

As described in each of the above embodiments, impedance is matched by placing the insulated ferrule 20 in the crimp structure.

What is claimed is:

1. A crimp structure, comprising:

a crimp section including an insulated ferrule disposed inside an outer conductor of a shielded cable, the insulated ferrule surrounds an insulation layer surrounding a core wire of the shielded cable, the outer conductor and a ground contact placed on an outer periphery of the outer conductor are crimped, the insulated ferrule compensates a thickness corresponding to a reduction in a diameter of the insulation layer due to the crimping such that a distance between the core wire of the shielded cable and the outer conductor in the crimp section is equal to a distance between the core wire and the outer conductor outside of the crimp section.

2. The crimp structure of claim 1, wherein, in the crimp section, an insulation layer surrounding the core wire of the shielded cable is removed, and the insulated ferrule surrounds the core wire.

3. The crimp structure of claim 1, wherein the insulated ferrule has a generally cylindrical shape.

4. The crimp structure of claim 3, wherein the insulated ferrule has a cut portion extending parallel to a central axis of the generally cylindrical shape.

5. The crimp structure of claim 4, wherein the cut portion is obtained by cutting a section between an inner periphery and an outer periphery of the generally cylindrical shape.

6. The crimp structure of claim 1, wherein the insulated ferrule is divided into a pair of parts parallel to a central axis.

7. The crimp structure of claim 6, wherein the pair of parts are allowed to coalesce and are generally cylindrical.

8. The crimp structure of claim 7, wherein the pair of parts form a pair of divided portions in a circumferential direction of the insulated ferrule.

9. The crimp structure of claim 8, wherein the insulated ferrule has a hinge connecting one of the pair of divided portions.

10. The crimp structure of claim 8, wherein the insulated ferrule has a recess-and-projection structure in which the divided portions are mated with each other.

11. The crimp structure of claim 1, wherein the insulated ferrule has a shape in which the insulated ferrule is wound in a coil form.

12. The crimp structure of claim 1, wherein the insulated ferrule is only disposed in the crimp section.

* * * * *